US007423603B1

(12) United States Patent
Staal

(10) Patent No.: US 7,423,603 B1
(45) Date of Patent: Sep. 9, 2008

(54) METHOD AND APPARATUS FOR STACKED WAVEGUIDE HORNS USING DUAL POLARITY FEEDS ORIENTED IN QUADRATURE

(76) Inventor: Michael B. Staal, 21679 Road 216, Friant, CA (US) 93626

( * ) Notice: Subject to any disclaimer, the term of this patent is extended or adjusted under 35 U.S.C. 154(b) by 0 days.

(21) Appl. No.: 11/754,909

(22) Filed: May 29, 2007

Related U.S. Application Data

(63) Continuation of application No. 10/976,691, filed on Oct. 28, 2004, now Pat. No. 7,239,284.

(51) Int. Cl.
*H01Q 13/00* (2006.01)

(52) U.S. Cl. ..... 343/774; 343/776

(58) Field of Classification Search ..... 343/772, 343/776, 778, 783, 786, 774
See application file for complete search history.

(56) References Cited

U.S. PATENT DOCUMENTS

| | | | | |
|---|---|---|---|---|
| 2,954,557 | A * | 1/1960 | Yang | 343/756 |
| 4,686,491 | A * | 8/1987 | Howard | 333/21 A |
| 6,211,750 | B1 * | 4/2001 | Gould | 333/21 A |
| 6,452,561 | B1 | 9/2002 | West et al. | |
| 6,778,146 | B2 | 8/2004 | Nakagawa et al. | |

* cited by examiner

*Primary Examiner*—Shih-Chao Chen
(74) *Attorney, Agent, or Firm*—Heimlich Law; Alan Heimlich, Esq.

(57) ABSTRACT

A method and apparatus for stacked waveguide horns using dual polarity feeds oriented in quadrature have been disclosed.

4 Claims, 10 Drawing Sheets

STACKED CIRCULAR HORN DETAIL

MOBILE OMNI WIRELESS 802.11 B SOLUTION
MUNICIPAL SERVICE SYSTEMS
( Police, Fire, Water Works etc. )

Omni Antenna System:

1. Non penetrating roof mount with 440 lbs. of optional water tank ballast.

A. UV Stabilized Polyethylene tanks
   B. 6' square base to spread load of unit.
   C. Rugged 37' Aluminum Crank Up mast.
   D. 1/8" Guy wire system to stabilize and add safety factor to installation 2. 90 Degree Sector Antenna ( 9dBi ) M2 Design to provide optimum efficiency with Medium vertical beamwidth to improve close coverage.

3. Antenna Enclosure – Low wind load area ( > 2 square feet ) and low visibility.

4. Includes Bi-directional Amplifiers.

Electronics System (Exterior):

1. Weather Proof enclosure mount at base of mast (typical application)

2. Includes Access Points, Power Supplies, Dc Injectors, Misc. Cable Assemblies. Power requirement – 115 / 230 VAC @ 3 Amps.

Mobile Antenna System:

1. Specifically designed by M2 ( 5dbi ) gain Vertical Omni antenna with main pattern at the horizon, providing maximum gain at distant locations.

2. Break over and pop back design, to eliminate damage or bending in car wash or special driving situations.

3. Extended base section to elevate antenna above the light bar or other roof mounted objects and to eliminate pattern distortion and provide maximum efficiency.

4. Non-penetrating mount design using "3M" bonding adhesive.

FIG. 3

S BAND STACK DUAL POLARITY HORNS IN QUADRATURE
EXPLODED OVER VIEW

SBNDNEW
M STAAL
10 10 05

MATERIAL: 3" OD X .065 SWAGED OPEN TO 3.125 I.D.

S BAND FEED PROBE

MATERIAL: .032 X .375 FLAT COPPER

S BAND WAVEGUIDE SHORT

MATERIAL: 3/16" ROUND, 6061-T6

MAKE ONE PER ANTENNA

METHOD AND APPARATUS FOR STACKED WAVEGUIDE HORNS USING DUAL POLARITY FEEDS ORIENTED IN QUADRATURE

RELATED APPLICATION

This patent application claims priority of U.S. Provisional Application Ser. No. 60/516,190 filed Oct. 31, 2003 titled "Method and Apparatus for Stacked Waveguide Horns using Dual Polarity Feeds Oriented in Quadrature", which is hereby incorporated herein by reference. The present Application for patent is a continuation of U.S. patent application Ser. No. 10/976,691 titled "Method and Apparatus for Stacked Waveguide Horns using Dual Polarity Feeds Oriented in Quadrature" filed Oct. 28, 2004 now U.S. Pat. No. 7,239,284, by the same inventor, and is hereby incorporated herein by reference.

FIELD OF THE INVENTION

The present invention pertains to communication systems. More particularly, the present invention relates to a method and apparatus for stacked waveguide horns using dual polarity feeds oriented in quadrature.

BACKGROUND OF THE INVENTION

Communication systems are pervasive in modern society. One of the most common is a wireless communications in the current form of cell phones. Geographic features, natural, as well as, man-made can cause issues with wireless communications. Distance, noise, signal strength, fading signals, multi-path signals are but a few of the issues challenging the wireless communications system designer. Designers must also contend with antenna placement, polarization, possible antenna height restrictions, as well as small transmitters with poor antennas, limited battery power, low Effective Radiated Power (ERP), etc. This presents a problem.

Cellular communications presents additional challenges in addition to those mentioned above because of the multitude of personal handsets, their variation, differing simultaneous communications, and many varying locations.

One approach that has been tried is to just use a medium gain omni-directional (omni) antenna to send and receive in all directions. The gain of the system is limited by the gain of the omni. From a transmission perspective, the omni may not present much of a problem if the system is running maximum Effective Isotropic Radiated Power (EIRP). A possible problem with an omni is that when transmitting equally in all directions, some of the signal can bounce off nearby objects and still be strong by the time they arrive at the receiver. This can create multipath distortion. Multipath can be a major source of poor data reception. Additionally, the polarity of the receiving antenna may not be of the same orientation as the omni (vertical for most omnis), so some signal may not be picked up. From the receive perspective, an omni suffers since it has low to medium gain and it is receiving noise and interference from all directions. So for example, if the signal arriving at the omni is not purely vertical polarity, then some signal is lost to polarity mismatch. This can be as high as a 20 dB loss. This presents a problem.

Yet another approach tries to account for this polarity mismatch by using circular polarization (CP) on transmit and receive. However if on receive, a signal is linearly polarized, then there is a 3 dB loss. If circularly polarized antenna(s) are directional, then they must be combined somehow. Using an isolating combiner, any signal out of phase with the main strongest receiving port will be sent to a termination and be lost. Additionally, the classic combining of several antennas pointed in different directions will bring in noise and interference that is not cancelled out due to phase mismatch. On transmit, the power will be transmitted in all directions in CP wasting all but the wanted direction and wasting another 3 dB if the antenna receiving the signal is linearly polarized. This presents a problem.

BRIEF DESCRIPTION OF THE DRAWINGS

The invention is illustrated by way of example and not limitation in the figures of the accompanying drawings in which:

FIGS. 3-10 illustrate various embodiments of the invention.

DETAILED DESCRIPTION

This design, as exemplified in various embodiments of the invention, illustrates how by using stacked waveguide horns using dual polarity feeds oriented in quadrature it is possible to produce an enhanced transmit and/or receive system.

In one embodiment the invention achieves virtual omnidirectivity by using stacked waveguide horns pointed in different directions.

In one embodiment of the invention, when receiving a signal, the signal can be optimized taking into account direction, phase, and polarity.

In one embodiment of the invention, when transmitting a signal, the signal can be optimized in direction, phase, and polarity so that it substantially matches the receive requirements on the other end of the communication path.

Figure 1:
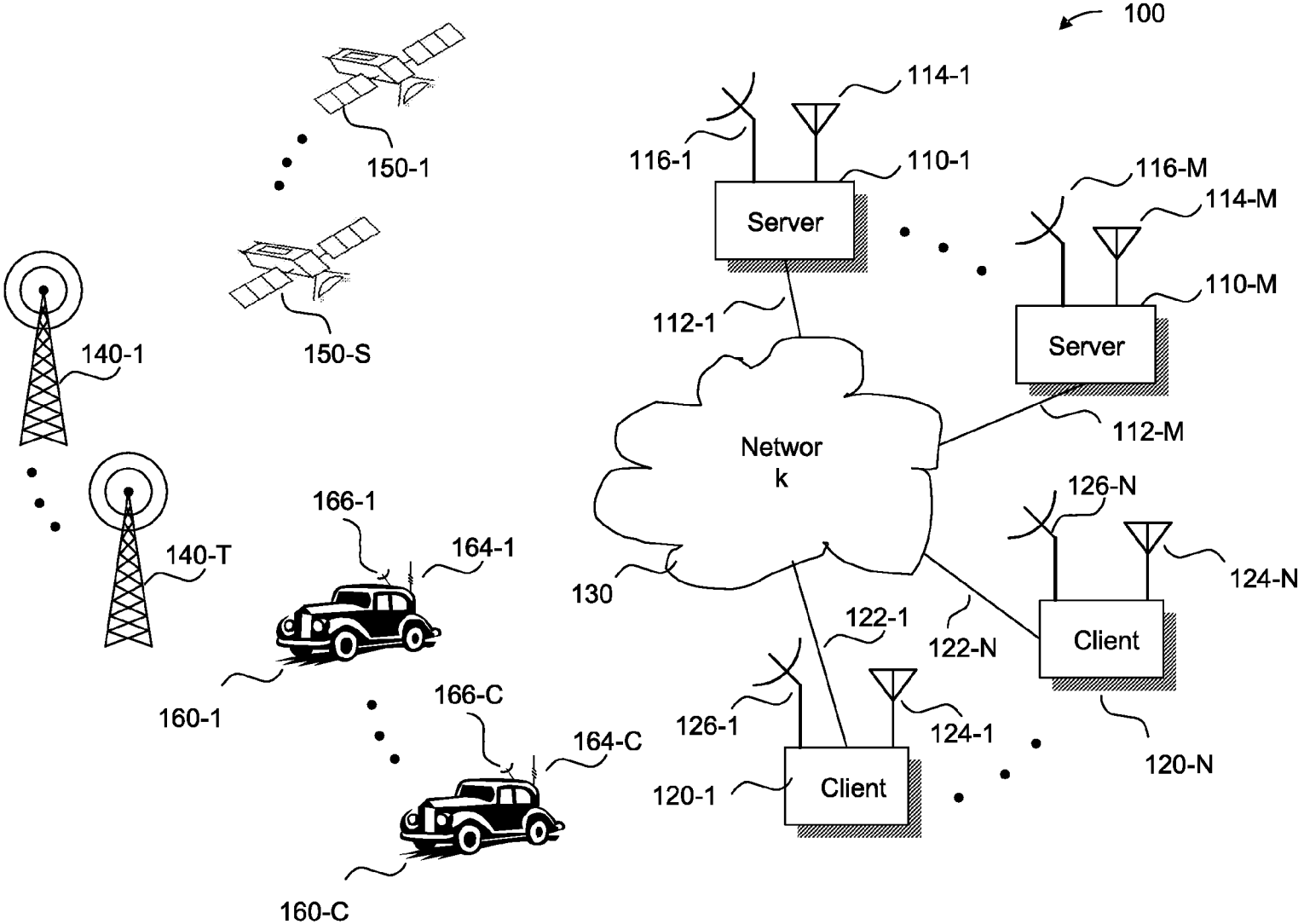
FIG. 1 illustrates a network environment in which the method and apparatus of the invention may be implemented.

FIG. 1 illustrates a network environment 100 in which the techniques described may be applied. More details are described below.

Figure 2:
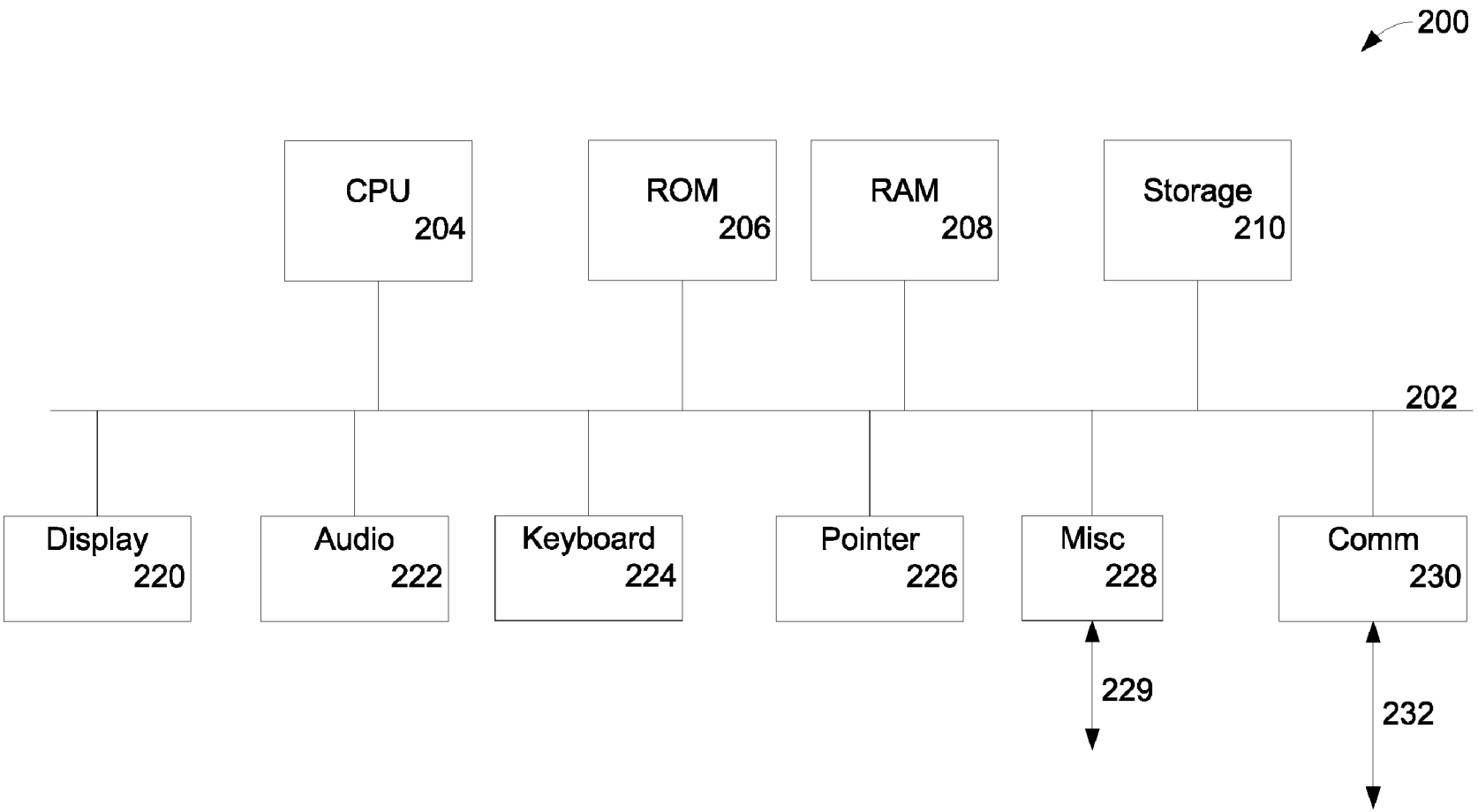
FIG. 2 is a block diagram of a computer system which may be used for implementing some embodiments of the invention.

FIG. 2 illustrates a computer system 200 in block diagram form, which may be representative of any of the devices shown in FIG. 1, as well as, devices, clients, and servers in other Figures. More details are described below.

FIG. 3 illustrates one embodiment of the invention 300 showing some features of the fully operational system. As such it may have three major components from a customer's perspective: 1) an omni directional antenna system 2) electronics and 3) mobile antenna system.

Figure 4:
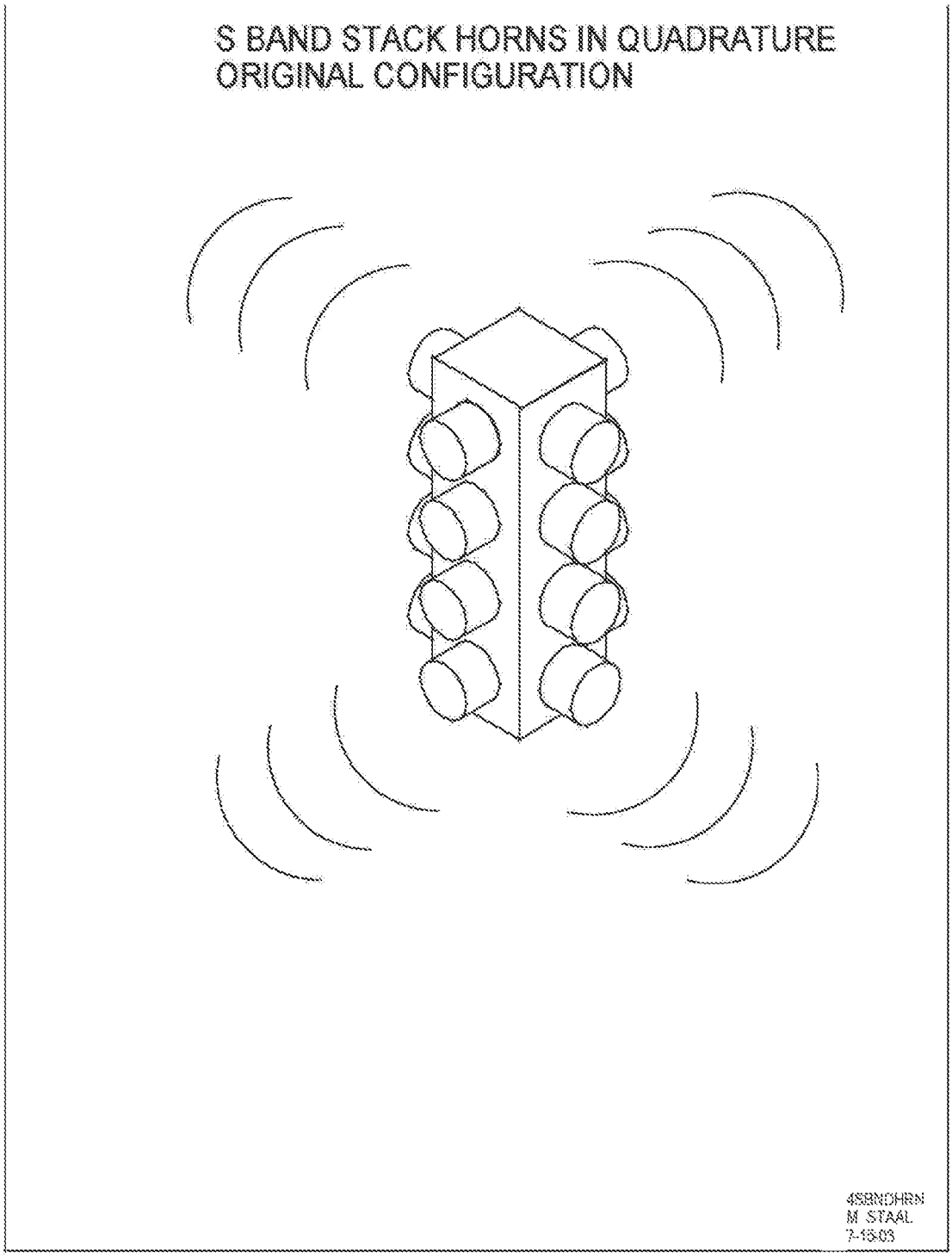

FIG. 4 illustrates another embodiment of the invention. In this embodiment are shown a series of four stacked antennas each set of stacked antennas being oriented in a different direction. By utilizing an arrangement as indicated in this embodiment, it is possible to provide substantially an omnidirectional capability.

Figure 5:
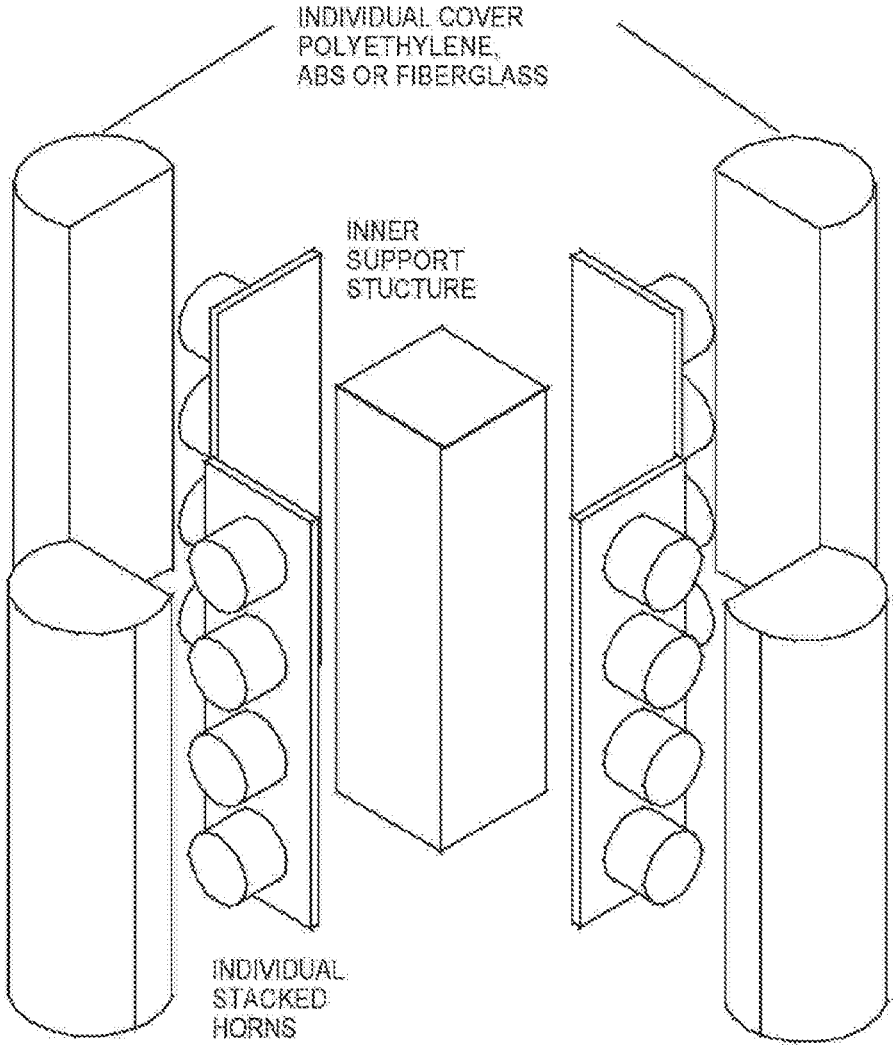

FIG. 5 illustrates one embodiment of the invention showing more details of possible antenna arrangement. In this embodiment, there is an inner support structure on which may be mounted, for example, four individual stacked horns each set of four stacked horns being oriented on the four faces of the inner support structure. Also shown are individual covers which may be used to protect the horns from environmental elements (weather). These individual covers may be made of a material which allows radio frequencies to pass and which protects the array from the weather. Such materials may include, for example, but are not limited to, polyethylene, ABS, fiberglass, etc.

Figure 6:
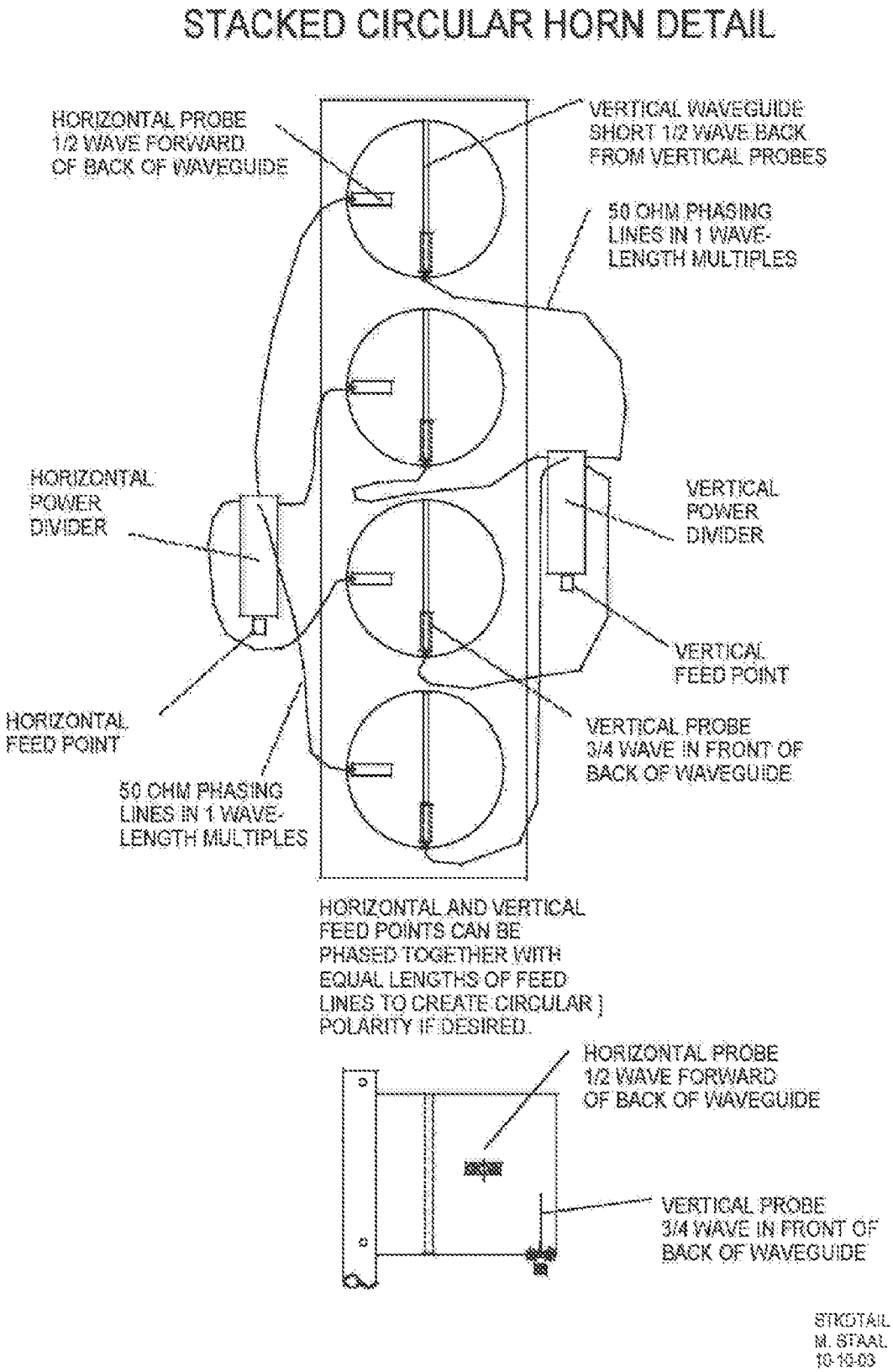

FIG. 6 shows more details of one embodiment of the present invention, a stacked circular horn array. A horizontal probe is located ½ wavelength forward from the back of the waveguide. A vertical probe is located ¾ wavelength in front of the back of the waveguide. In alignment with the vertical probe is a vertical waveguide short which is ½ wavelength back from the vertical probe. As illustrated in this embodiment the vertical probes are phased with equal length lines to a vertical power divider. Likewise, as illustrated in this embodiment the horizontal probes are phased with equal length lines to a horizontal power divider. If the horizontal and vertical feed points are phased with equal lengths of feed lines then it is possible to create circular polarities if desired.

Figure 7:
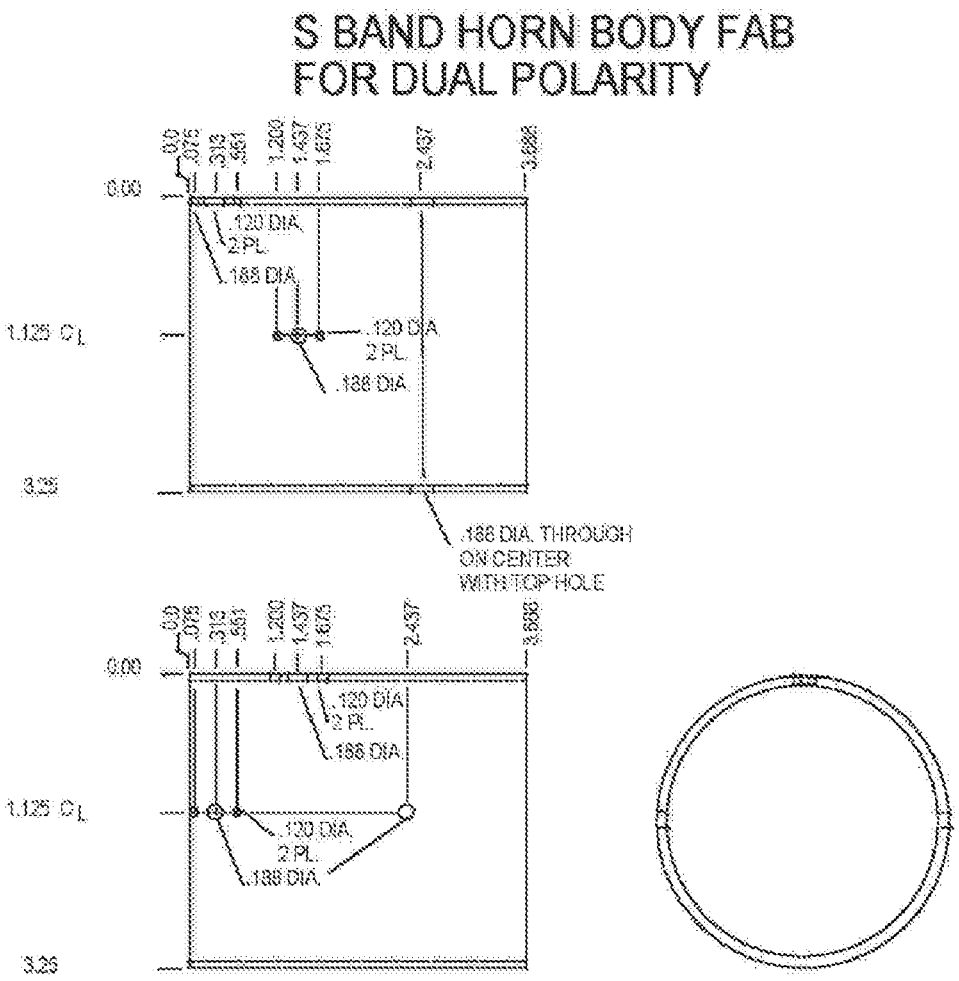

FIG. 7 illustrates more detail of one embodiment of the invention relating to the fabrication details of an S band horn body for dual polarity.

Figure 8:
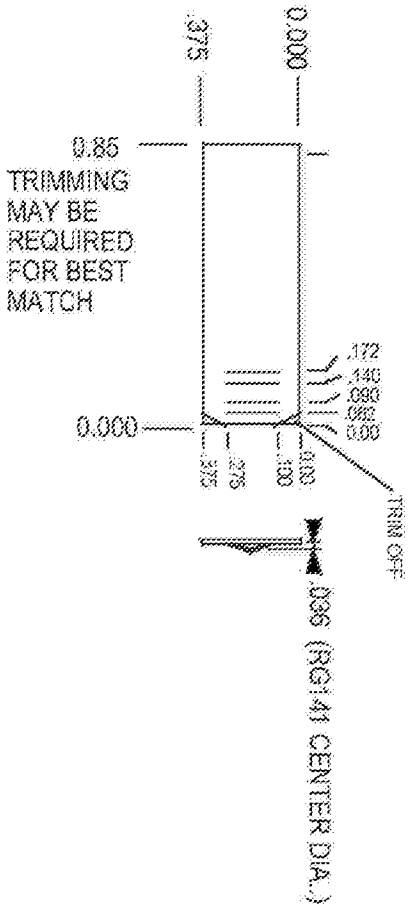

FIG. 8 shows in greater detail, in this embodiment of the invention, a feed probe. As indicated the feed probe may be trimmed for providing the best match. Also shown is an exemplary material for the feed probe, in this case being 0.032×0.375 flat copper.

Figure 9:
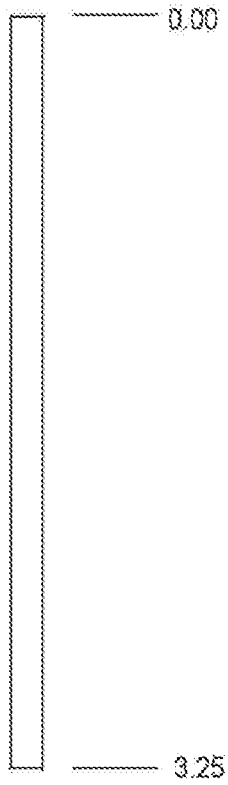

FIG. 9 indicates one embodiment of the invention waveguide short as described and illustrated in FIG. 6.

Figure 10:
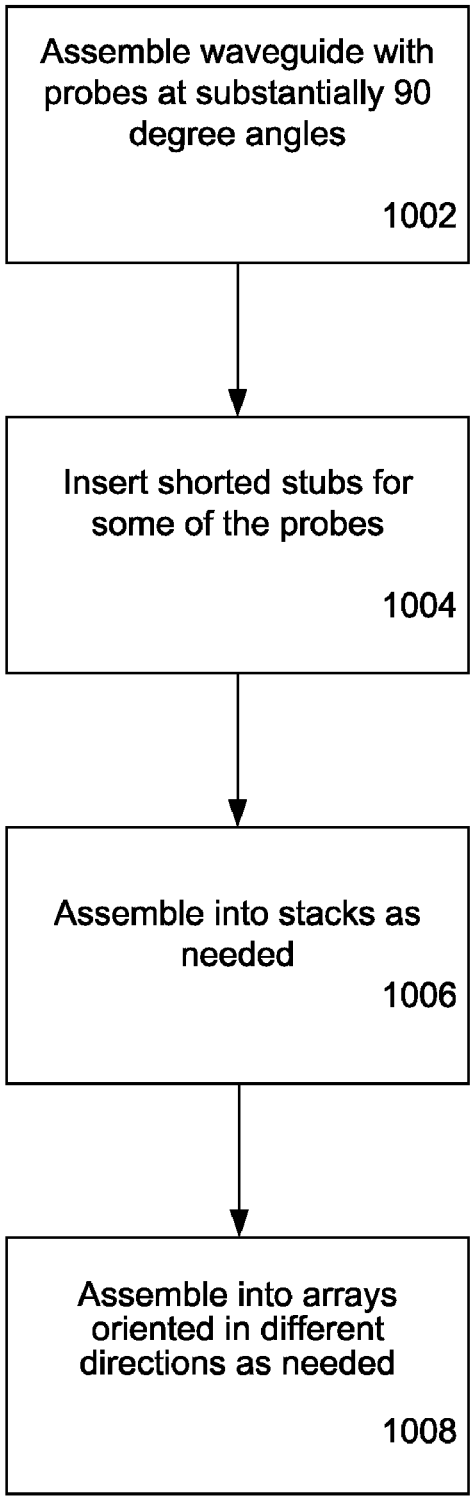

FIG. 10 illustrates a method for producing one embodiment of the invention. At 1002 a waveguide with probes substantially 90 degrees apart is assembled. At 1004 shorted stubs as illustrated, for example in FIG. 9, are inserted into the waveguide for some of the probes. At 1006 waveguides are assembled into stacks as needed. At 1008 the waveguide stacks are assembled into an array with some of the guides oriented in different directions.

In one embodiment of the invention, the frequency used was 2.4 to 2.5 GHz. The embodiment is a relatively simple, medium gain, dual polarity or circular polarity antenna system that may be used to produce virtual omnidirectivity using four channels of off the shelf 802.11B access points.

In one embodiment, a round waveguide was used as the starting point, because it can be excited simultaneously in dual or multiple polarities. When the feed is located at or near, one-half wavelength from the closed end of a round waveguide it is very easy to match to 50 ohms and produces some gain and reasonable front to back. Making the waveguide length just over one-half wavelength long produces a wide beamwidth of just under 90 degrees. These horns may be used in a vertical stack to produce a narrow vertical beamwidth and yet achieve a near 90 degree azimuth pattern. Wide azimuth beamwidth more than high gain may be needed so when four such arrays are oriented around the compass (for example, one North, one East one South and one West) it creates a virtual omnidirectional azimuth pattern. In order to optimize the antenna system for real world multipath situations, both on transmit and on receive, another set of probes are placed at 90 degrees to the first probe in each horn. When the probes are placed at the same distance from the shorted end of the waveguide, the tips or hot ends of the probe feeds are closely coupled and minimum vertical to horizontal polarity isolation can be achieved. Better isolation is achieved by placing the probes in the horn so that they are one-quarter wavelength apart. This improves the isolation, for example, to over 20 dB, however, since one probe is now just one-quarter wavelength from the shorted end of the waveguide its impedance is radically different from the probe spaced at one-half wavelength from the shorted end of the waveguide. To compensate somewhat for this, the waveguide may be made three-quarter wavelength deep, and placing the forward probe near the edge of the horn, three-quarter wavelength from the shorted end of the waveguide. The inner probe is now one-half wavelength from the shorted end and it may be matched to 50 Ohms rather easily. The front probe however exhibits the radical impedance that the rear probe had as the front probe is now an odd quarter wavelength from the shorted end. To compensate for this anomaly, and without affecting the inner probe impedance or performance substantially, a conductive rod may be positioned from one side of the waveguide to the other (shorted across the round waveguide) and in the plane of the front probe. The rod is placed one-half wavelength behind the front probe or one-quarter wavelength from the shorted end. Now the forward probe acts as if it is seeing a shorted waveguide one-half wavelength behind its location and its impedance now returns to substantially the same value as if located at one-half wavelength shorted waveguide. The bandwidth with this configuration is at least 25%. This is much wider than the bandwidth of a probe located at odd quarter wavelength multiples from the shorted end of the waveguide.

Spacing of the individual horns in a stack may be accomplished using two methods. Since a round waveguide is difficult to computer model, one may simulate the horn modeling as a 2 element Yagi. Once the Yagi is adjusted for 90 degree beamwidth, one can model a stack of four 2 element Yagi antennas and optimize the spacing distance for near optimum gain, while still maintaining a first side lobe level of −12 dB to −13 dB. This same spacing may then be used to space the 4 round waveguide antennas. In one embodiment of the invention, gain was measured at about 13.3 dBi. When the spacing between the individual horns was adjusted closer together and further apart, the result showed that the best gain and pattern was achieved at the computer optimized stacking distance found modeling the 2 element Yagi. It should be noted that the gain and pattern changed very slowly as the spacing was changed. It should also be noted that the expected increase in vertical side lobe level did not increase as expected and as seen when computer modeling the Yagis. This is not normal behavior and is an unexpected result. The gain, as expected, dropped away with increased spacing.

In one embodiment of the invention, once the single horn stack of four was optimized, then 3 more identical systems were built and each mounted on a face of an 18" long section of 4½" square aluminum extrusion. When the second horn stack was mounted, gain of the first stack appeared to increase by about 0.5 dB. This was unexpected and at first was discounted as a range or measurement error. However, when the third stack was mounted on the opposite side from the second, the gain of the first stack was again tested and this time found to be approximately 1 dB better than when tested as a single unit. This is an unexpected improvement with no apparent loss of azimuth beamwidth. The vertical pattern may be somewhat narrower, however, this is of little concern for the design application.

The invention while described and illustrated for use in the 2.4 GHz cellular range is not so restricted. The reference to use of round or circular waveguides and probes and gain enhancing elements that can be added to a waveguide should not be taken as restricting the invention. The invention may be used with rectangular waveguides, etc. One of skill in the art will appreciate that the feed probe location may also be located at the face of the waveguide as illustrated in several of the Figures. Additionally, the invention may be used at any frequency.

The invention may be used in a transceive mode or just a "receive only" mode, or a "transmit only" mode. The invention may be used equally well with digital signals or analog signals as well as a variety of modulation methods. Additionally, the "combining" of the signals may be performed in real-time as well as a more static mode as needed depending upon the possible movement of the communication devices. For example, a stationary cell phone may need fewer real-time "combining" operations than one that is inside, for example, a rapidly moving car in a city having many buildings contributing to multiple multipath signals.

It is to be further appreciated that while the invention has been illustrated with respect to a single communication taking place, that the invention is not so limited. Multiple communications occurring simultaneously each with varying polarity, delays, etc. may be handled by the invention techniques described.

What is to be appreciated is the use of direction diversity and polarity diversity antennas, combined with an intelligent receiving system that can make use of all the signals received regardless of phase and add them together to produce a better signal to noise ratio of the desired signal Thus a method and apparatus for stacked waveguide horns using dual polarity feeds oriented in quadrature have been described.

Referring back to FIG. 1, FIG. 1 illustrates a network environment 100 in which the techniques described may be applied. A plurality of computer systems are shown in the form of M servers (110-1 through 110-M), and N clients (120-1 through 120-N), which are coupled to each other via network 130. A plurality of terrestrial based wireless communications links are shown in the form of T towers (140-1 through 140-T). A plurality of space based communications links are shown as S satellites (150-1 through 150-S). A plurality of vehicles are shown in the form of C cars (160-1 through 160-C). The M servers and N clients may also be coupled to each other via space based communications links 150-1 through 150-S, as well as terrestrial based wireless communications links 140-1 through 140-T, or a combination of satellite and terrestrial wireless links. Additionally, the C cars 160-1 through 160-C may be in communication with the satellites 150-1 through 150-S and/or the terrestrial wireless links 140-1 through 140-T.

Servers 110-1 through 110-M may be connected to network 130 via connections 112-1 through 112-M, respectively. Servers 130-1 through 130-M may be connected to the terrestrial links 140-1 through 140-T via antennae 114-1 through 114-M, respectively. Servers 110-1 through 110-M may be connected to space based communications links 150-1 through 150-S via dish antennae 116-1 through 116-M.

Clients 120-1 through 120-N may be connected to the network 130 via connections 122-1 through 122-N. Clients 120-1 through 120-N may be connected to the terrestrial links 140-1 through 140-T via antennae 124-1 through 124-N. Clients 120-1 through 120-N may be connected to space based communications links 150-1 through 150-S via dish antennae 126-1 through 126-N.

Cars 160-1 through 160-C may be connected to the terrestrial links 140-1 through 140-T via antennae 164-1 through 164-C. Cars 160-1 through 160-C may be connected to space based communications links 150-1 through 150-S via antennae 166-1 through 166-C.

Clients 120-1 through 120-N may consist of, but are not limited to, for example, a set-top box, a receiver, a television, a game platform, or other receiving devices such as portable cell phones. Applications may be running on the clients 120-1 through 120-N, while web pages and information being browsed may reside on the servers 110-1 through 110-M. Broadcasts may be coming from terrestrial sources 140-1 through 140T, and/or satellite links 150-1 through 150-S. For purposes of explanation, a single communication channel will be considered to illustrate one embodiment of the present techniques. It will be readily apparent that such techniques may be easily applied to multiple communication channels as well as simultaneous communications.

Network 130 may be a Wide Area Network (WAN), which includes the Internet, or other proprietary networks, such as America On-Line®, CompuServe®, Microsoft Network®, and Prodigy®. Note that alternatively the network 130 may include one or more of a Local Area Network (LAN), satellite link, fiber network, cable network, or any combination of these and/or others. Network 130 may also include network backbones, long-haul telephone lines, Internet service providers, and various levels of network routers.

Terrestrial links 140-1 through 140-T may be, for example, wireless cellular telephone service providers. Space based communications links 170-1 through 170-S may be, for example, satellite broadcasters, global positioning satellites (GPS), etc. Communications system 100 may be implemented in any number of environments.

The invention may find application at in any of the items depicted in FIG. 1.

Referring back to FIG. 2, FIG. 2 illustrates a computer system 200 in block diagram form, which may be representative of any of the clients and/or servers shown in FIG. 1, as well as a processing system which may be in any of the items shown in FIG. 1. The block diagram is a high level conceptual representation and may be implemented in a variety of ways and by various architectures. Bus system 202 interconnects a Central Processing Unit (CPU) 204, Read Only Memory (ROM) 206, Random Access Memory (RAM) 208, storage 210, display 220, audio, 222, keyboard 224, pointer 226, miscellaneous input/output (I/O) devices 228, and communications 230. The bus system 202 may be for example, one or more of such buses as a system bus, Peripheral Component Interconnect (PCI), Advanced Graphics Port (AGP), Small Computer System Interface (SCSI), Institute of Electrical and Electronics Engineers (IEEE) standard number 1394 (FireWire), Universal Serial Bus (USB), etc. The CPU 204 may be a single, multiple, or even a distributed computing resource. Storage 210, may be Compact Disc (CD), Digital Versatile Disk (DVD), hard disks (HD), optical disks, tape, flash, memory sticks, video recorders, etc. Display 220 might be, for example, a Cathode Ray Tube (CRT), Liquid Crystal Display (LCD), a projection system, Television (TV), etc. Note that depending upon the actual implementation of a computer system, the computer system may include some, all, more, or a rearrangement of components in the block diagram. For example, a thin client might consist of a wireless hand held device that lacks, for example, a traditional keyboard. Thus, many variations on the system of FIG. 2 are possible.

For purposes of discussing and understanding the invention, it is to be understood that various terms are used by those knowledgeable in the art to describe techniques and approaches. Furthermore, in the description, for purposes of explanation, numerous specific details are set forth in order to provide a thorough understanding of the present invention. It will be evident, however, to one of ordinary skill in the art that the present invention may be practiced without these specific details. In some instances, well-known structures and devices are shown in block diagram form, rather than in detail, in order to avoid obscuring the present invention. These embodiments are described in sufficient detail to enable those of ordinary skill in the art to practice the invention, and it is to be understood that other embodiments may be utilized and that logical, mechanical, electrical, and other changes may be made without departing from the scope of the present invention.

Some portions of the description may be presented in terms of algorithms and symbolic representations of operations on, for example, data bits within a computer memory. These algorithmic descriptions and representations are the means used by those of ordinary skill in the data processing arts to most effectively convey the substance of their work to others of ordinary skill in the art. An algorithm is here, and generally, conceived to be a self-consistent sequence of acts leading to a desired result. The acts are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion, it is appreciated that throughout the description, discussions utilizing terms such as "processing" or "computing" or "calculating" or "determining" or "displaying" or the like, can refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

An apparatus for performing the operations herein can implement the present invention. This apparatus may be specially constructed for the required purposes, or it may comprise a general-purpose computer, selectively activated or reconfigured by a computer program stored in the computer. Such a computer program may be stored in a computer readable storage medium, such as, but not limited to, any type of disk including floppy disks, hard disks, optical disks, compact disk-read only memories (CD-ROMs), and magnetic-optical disks, read-only memories (ROMs), random access memories (RAMs), electrically programmable read-only memories (EPROM)s, electrically erasable programmable read-only memories (EEPROMs), FLASH memories, magnetic or optical cards, etc., or any type of media suitable for storing electronic instructions either local to the computer or remote to the computer.

The algorithms and displays presented herein are not inherently related to any particular computer or other apparatus. Various general-purpose systems may be used with programs in accordance with the teachings herein, or it may prove convenient to construct more specialized apparatus to perform the required method. For example, any of the methods according to the present invention can be implemented in hard-wired circuitry, by programming a general-purpose processor, or by any combination of hardware and software. One of ordinary skill in the art will immediately appreciate that the invention can be practiced with computer system configurations other than those described, including hand-held devices, multiprocessor systems, microprocessor-based or programmable consumer electronics, digital signal processing (DSP) devices, set top boxes, network PCs, minicomputers, mainframe computers, and the like. The invention can also be practiced in distributed computing environments where tasks are performed by remote processing devices that are linked through a communications network.

The methods of the invention may be implemented using computer software. If written in a programming language conforming to a recognized standard, sequences of instructions designed to implement the methods can be compiled for execution on a variety of hardware platforms and for interface to a variety of operating systems. In addition, the present invention is not described with reference to any particular programming language. It will be appreciated that a variety of programming languages may be used to implement the teachings of the invention as described herein. Furthermore, it is common in the art to speak of software, in one form or another (e.g., program, procedure, application, driver, . . . ), as taking an action or causing a result. Such expressions are merely a shorthand way of saying that execution of the software by a computer causes the processor of the computer to perform an action or produce a result.

It is to be understood that various terms and techniques are used by those knowledgeable in the art to describe communications, protocols, applications, implementations, mechanisms, etc. One such technique is the description of an implementation of a technique in terms of an algorithm or mathematical expression. That is, while the technique may be, for example, implemented as executing code on a computer, the expression of that technique may be more aptly and succinctly conveyed and communicated as a formula, algorithm, or mathematical expression. Thus, one of ordinary skill in the art would recognize a block denoting A+B=C as an additive function whose implementation in hardware and/or software would take two inputs (A and B) and produce a summation output (C). Thus, the use of formula, algorithm, or mathematical expression as descriptions is to be understood as having a physical embodiment in at least hardware and/or software (such as a computer system in which the techniques of the present invention may be practiced as well as implemented as an embodiment).

A machine-readable medium is understood to include any mechanism for storing or transmitting information in a form readable by a machine (e.g., a computer). For example, a machine-readable medium includes read only memory (ROM); random access memory (RAM); magnetic disk storage media; optical storage media; flash memory devices; electrical, optical, acoustical or other form of propagated signals (e.g., carrier waves, infrared signals, digital signals, etc.); etc.

As used in this description, "one embodiment" or "an embodiment" or similar phrases means that the feature(s) being described are included in at least one embodiment of the invention. References to "one embodiment" in this description do not necessarily refer to the same embodiment; however, neither are such embodiments mutually exclusive. Nor does "one embodiment" imply that there is but a single embodiment of the invention. For example, a feature, structure, act, etc. described in "one embodiment" may also be included in other embodiments. Thus, the invention may include a variety of combinations and/or integrations of the embodiments described herein.

Thus a method and apparatus for stacked waveguide horns using dual polarity feeds oriented in quadrature have been described.

What is claimed is:

1. An apparatus comprising:

(a) a round cylindrical waveguide having a flat closed end substantially perpendicular to the axis of said round cylindrical waveguide and an open end;

(b) a waveguide shorting probe substantially the diameter of said round cylindrical waveguide spaced substantially parallel to said flat closed end at substantially one-quarter wavelength from said flat closed end and located within said round cylindrical waveguide and connected at each end to said round cylindrical waveguide, said waveguide shorting probe being at a third orientation;

(c) a first probe shorter than the diameter of said round cylindrical waveguide spaced substantially parallel to said flat closed end at substantially one-half wavelength from said flat closed end and extending within said round cylindrical waveguide and one end not connected and one end connected to a first feed line, said first probe being at a first orientation;

(d) a second probe shorter than the diameter of said round cylindrical waveguide spaced substantially parallel to said flat closed end at substantially three-quarters wavelength from said flat closed end and extending within said round cylindrical waveguide and one end not connected and one end connected to a second feed line, said second probe being at a second orientation;

(e) wherein said second orientation and said third orientation are the same orientation, and said first orientation is substantially quadrature to said same orientation;

(f) wherein said round cylindrical waveguide is substantially three-quarters wavelength in length; and the apparatus (a) through (f) being denoted a circular horn and the apparatus comprising two or more said circular horns positioned substantially in a stacked arrangement wherein all of said circular horns first orientation are in a same direction.

2. The apparatus of claim 1 being denoted a stacked circular horn array and the apparatus of claim 1 further comprising two or more said stacked circular horn arrays positioned in an arrangement wherein all of said circular horns first orientation are in a same direction and the axis of each said circular horn are substantially parallel.

3. The apparatus of claim 1 being denoted a stacked circular horn array and the apparatus of claim 1 further comprising two or more said stacked circular horn arrays each said stacked circular horn array positioned in a different direction than the others.

4. The apparatus of claim 3 having four stacked circular horn arrays each positioned substantially in quadrature.

* * * * *